US008240996B2

(12) United States Patent
Surls

(10) Patent No.: US 8,240,996 B2
(45) Date of Patent: Aug. 14, 2012

(54) SYNERGISTIC BLADE AND HUB STRUCTURE FOR COOLING FANS

(75) Inventor: Michael M. Surls, Marshall, MI (US)

(73) Assignee: BorgWarner Inc., Auburn Hills, MI (US)

( * ) Notice: Subject to any disclaimer, the term of this patent is extended or adjusted under 35 U.S.C. 154(b) by 328 days.

(21) Appl. No.: 12/598,281

(22) PCT Filed: May 10, 2008

(86) PCT No.: PCT/US2008/063352

§ 371 (c)(1),
(2), (4) Date: Oct. 30, 2009

(87) PCT Pub. No.: WO2008/141253

PCT Pub. Date: Nov. 20, 2008

(65) Prior Publication Data

US 2010/0092297 A1 Apr. 15, 2010

Related U.S. Application Data

(60) Provisional application No. 60/917,137, filed on May 10, 2007.

(51) Int. Cl.
*F04D 29/34* (2006.01)

(52) U.S. Cl. ..... 416/169 A; 416/236 R

(58) Field of Classification Search ..... 416/169 A, 416/236 R, 236 A, 235
See application file for complete search history.

(56) References Cited

U.S. PATENT DOCUMENTS 6,375,427 B1 * 4/2002 Williams et al. ..... 416/169 A
6,382,915 B1 * 5/2002 Aschermann et al. .... 416/169 A
6,565,320 B1 * 5/2003 Surls et al. ..... 416/175
6,726,454 B2 * 4/2004 Blass et al. ..... 416/236 R

* cited by examiner

*Primary Examiner* — Richard Edgar

(57) ABSTRACT

A synergistic blade and hub structure for a cooling fan. Helical gussets are provided which proceed from the central hub member adjacent one blade member to the trailing edge of an adjacent blade member. The helical gussets provide structural load paths as well as aerodynamic flow guides. The helical gussets extend axially rearwardly to the trailing edges of preceding blade members and provide structural attachments between the leading and trailing edges of adjacent blade members. Hollow triangular structures are also provided on the rear of the fan structure and the triangulation area provides superior stiffness.

6 Claims, 3 Drawing Sheets

SYNERGISTIC BLADE AND HUB STRUCTURE FOR COOLING FANS

TECHNICAL FIELD

The present invention relates to fans and particularly cooling fans for automobiles and other vehicles.

BACKGROUND OF THE INVENTION

Engines for an automobiles, trucks, or other vehicles operate at high operating temperatures and thus needs various mechanisms to provide cooling. Typically, circulation of a cooling fluid and/or forced circulation of air passed the engine and it components and accessories, are conventionally used to provide cooling for such engines.

Water or fluid cooled engines utilize radiators which are positioned in the incoming flow of air are used to cool the water or other fluid after it has been heated by the engine. Cooling fans are positioned adjacent the radiator in order to force or pull air flow through the radiator and thus to cool the water or other fluid.

Initially, cooling fans were virtually all made from a metal material. More commonly today, the cooling fans are made from a plastic material. The fans can be a traditional type member having a central hub and a plurality of outwardly extending impeller blades, or the fan can be a ring-type fan with a circumferential ring positioned on the ends or tips of the blades.

Also, typically a conduit or shroud member is positioned around the fan member in order to help direct the air flow in the engine compartment of the vehicle in a desired manner.

There is a need for improved cooling fans for use in trucks, automobiles, and other vehicles. There is a particular need for improved cooling fans made of a plastic material which have increased stiffness and durability and which can be manufactured in an easier manner.

SUMMARY OF THE INVENTION

The present invention provides an improved fan member particularly for use as a cooling fan in trucks, automobiles and other vehicles. The invention provides a fan made of a plastic material with minimum weight and maximum stiffness. Helical gussets are provided which proceed from the hub diameter of one blade member to the trailing edge of an adjacent blade member. The curved gussets achieve a triangulation structure between two adjacent blades which increases the stiffness and durability of the fan member. The helical gussets provide structural load paths as well as aerodynamic flow guides to move the air from the forward fan hub region to the blade flow path region.

As the gusset proceeds in a curved helical direction toward the leading edge of its associated blade member, it extends axially rearwardly to the trailing edge of the preceding blade member. This provides structural attachment between the leading and trailing edges of adjacent blade members. This also provides structural bending stiffness between the blade members.

The blade leading edge is also extended to follow the helical gusset into the hub region. The rear of the fan in the hub region below the helical gusset is hollowed axially forward and preferably has a triangular shape. This provides a minimal material structure, but one with superior structural stiffness and strength.

Other benefits, features, and advantages of the present invention will become apparent from the following description of the invention, when viewed together with the accompanying drawings and appended claims.

DESCRIPTION OF PREFERRED EMBODIMENTS

Figure 1:
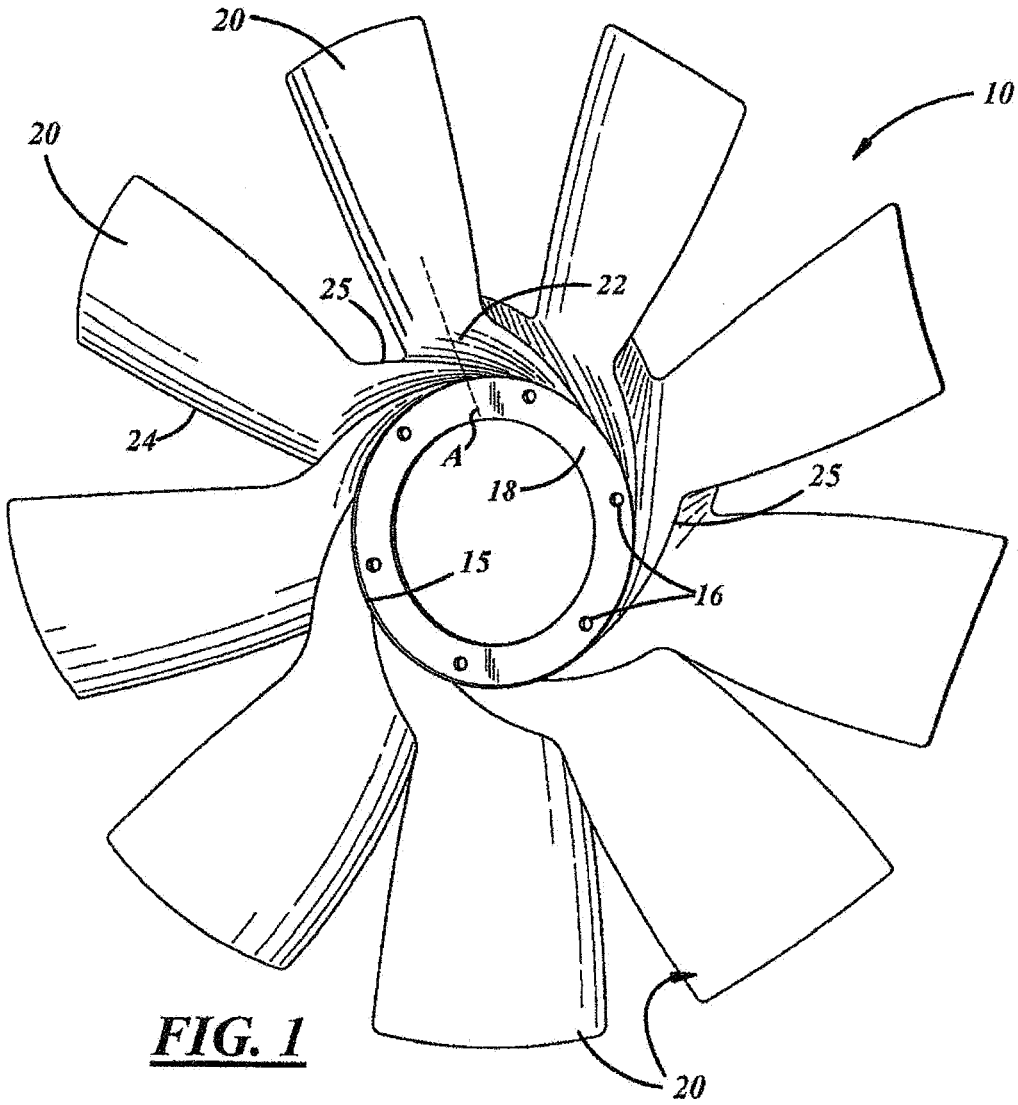
FIG. 1 is a perspective front view of an embodiment of a cooling fan member in accordance with the present invention.

The present invention provides a synergistic blade and hub structure for cooling fans. The cooling fans are particularly used in vehicles, such as trucks and automobiles. However, the invention is not limited to cooling fans for vehicles, but also encompasses a unique fan structure for use in many various applications, including industrial-type applications.

The cooling fan member in accordance with the present invention is made from a plastic material, such as nylon or another polymer suitable for underhood environments in vehicles, and is preferably made by an injection molding process. The present invention provides an improved manufacturing process and final product since the fan design, including the blade members and the hub, all have a substantially uniform thickness. This minimizes the cycle time for the injection molding process and also prevents heat sinks and other molding imperfections.

As shown in FIGS. 1-6, a cooling fan embodiment in accordance with the present invention is referred to generally by the reference numeral 10. The cooling fan member has a central hub member 15 and a plurality of impellers or blade members 20. In the drawings, the cooling fan member 10 is depicted as having nine blade members 20. It is to be understood, however, that the cooling fan in accordance with the present invention can have any desired number of blade members. Also, preferably the number of blade members is a prime number such as 7, 9, 11, 13, etc. for each fan member.

Figure 2:
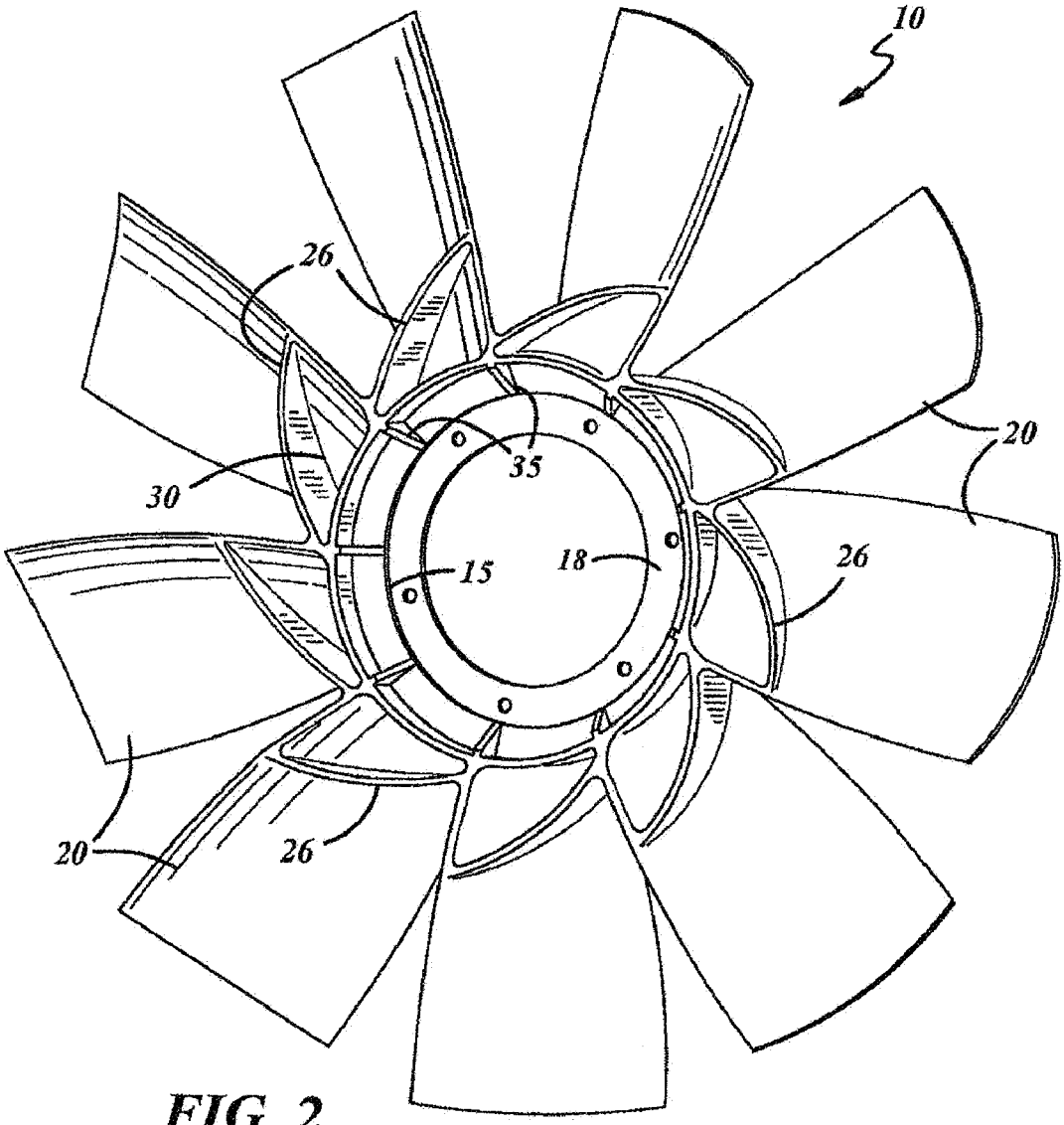
FIG. 2 is a rear view of the cooling fan as shown in FIG. 1.
Figure 3:
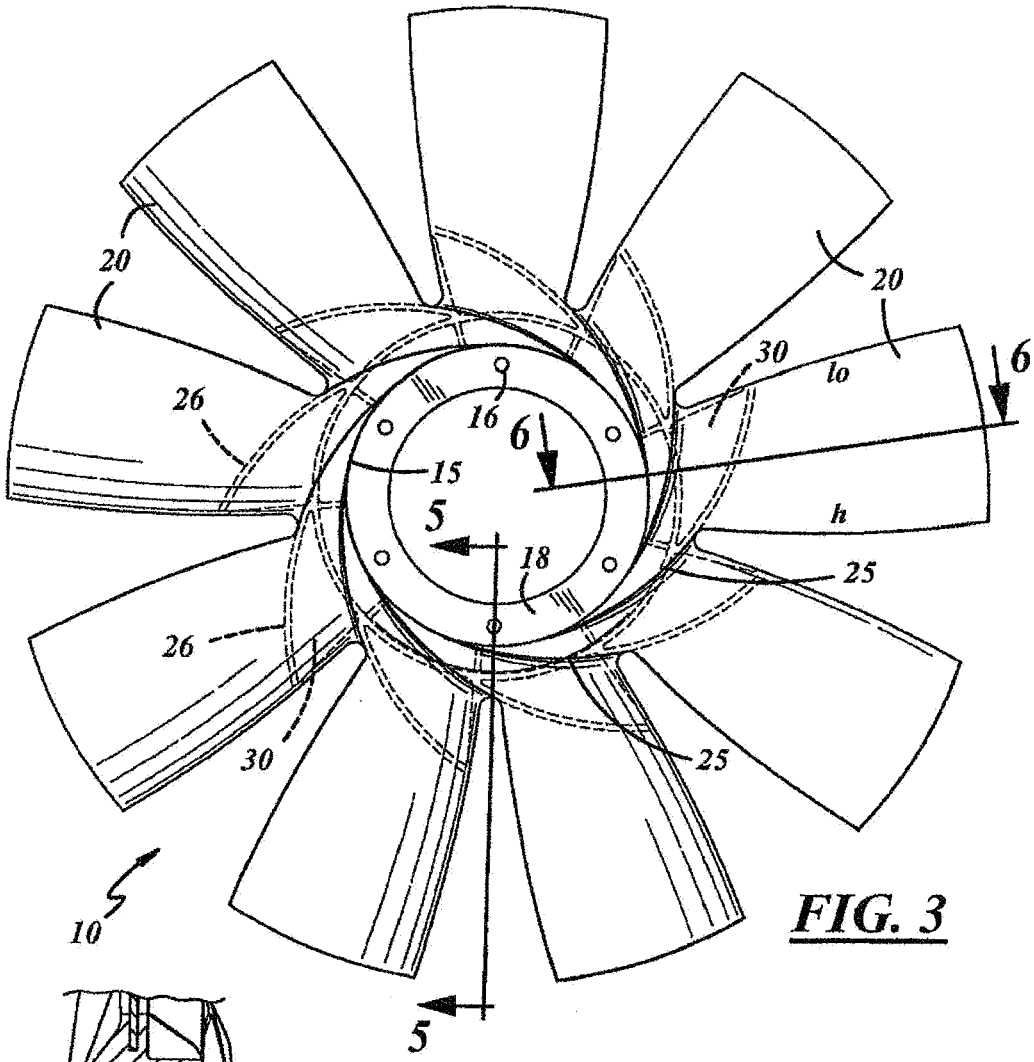
FIG. 3 is another view of the cooling fan embodiment as shown in FIGS. 1 and 2, with hidden lines showing the helical gussets.
Figure 5:
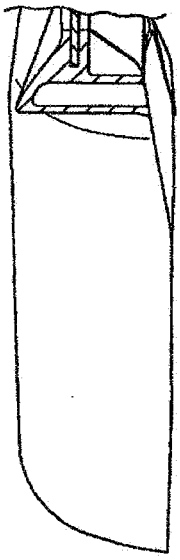
FIGS. 5 and 6 are cross-sectional illustrations of the fan embodiment shown in FIG. 1, the cross-sections taken along lines 5-5 and 6-6, respectively, in FIG. 3.
Figure 6:
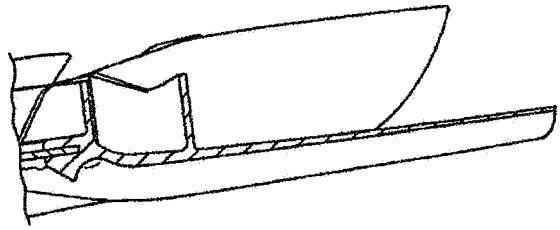

It is also preferable, as shown in FIGS. 1-3, to utilize a metal insert member 18 positioned in and secured to the hub member of the fan member in order to assist in mounting the fan member to a shaft member or the like. For this purpose, a number of openings 16 are provided in the insert member 18. The openings are used to position fasteners for mounting the fan to or on a shaft or other structure.

The fan member 10 has a plurality of helical gussets 25 that extend from the hub member 15 over the surfaces of each of the blade members 20. The helical gussets are curved radially outwardly and proceed from the hub member substantially at the midsection 22 of one blade member to the trailing edge 24 of the adjacent blade.

The width of the helical gussets 25 is increased or decreased as necessary to provide the union of blades from the leading edge of one blade member to the trailing edge of the adjacent blade member. The width of the helical gussets is also increased or decreased based on the amount of material needed to provide the desired stiffness of the fan. The precise size and width of the gussets also is preferably selected in order to provide stacking of the fans for shipment and transport.

The helical gussets 25 provide structural load paths as well as aerodynamic flow guides to move the air flow from the forward fan hub region into the blade flow path region. As the gusset structures proceed in a helical direction toward the leading edge of the associated blade member, they also extend axially rearwardly to the trailing edge of the preceding blade. This is shown particularly in FIG. 2. In this regard, the rear surfaces or edges of the helical gussets are referred to by the reference numeral 26 in FIG. 2. The helical gussets provide structural attachments between the leading and trailing edges of adjacent blade members. This provides structural bending stiffness between the blades. Extending the helical gussets to the trailing edge of its associated blade member serves to continue the flow guide, provide further structural bending stiffness, and stabilizes the trailing edge of the blade member. Stabilizing the trailing edge angle assures optimizing performance under load.

Due to the structural strength added by the helical gusset members, minimum blade sectional thicknesses are needed to carry the blade loads. Additionally, the hub geometry thicknesses can be reduced due to load sharing between the hub member, helical gussets, and the blade sections inboard of the helical gussets. This provides a triangulation structure 30 as better shown in FIGS. 2 and 4.

Figure 4:
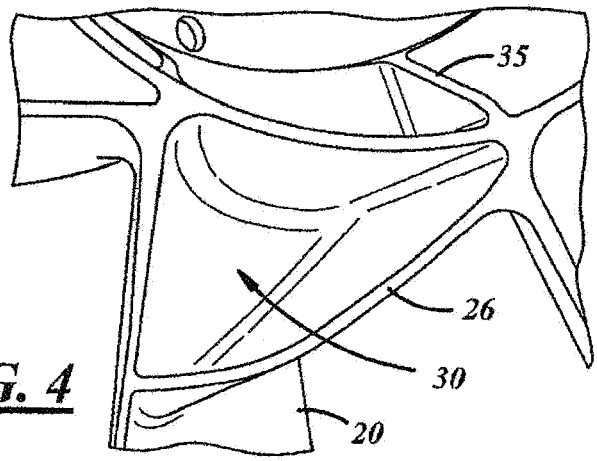
FIG. 4 is an enlarged view of the rear of the cooling fan as shown in FIGS. 1-3 and illustrating the triangular-shaped hollow region preferably formed in one embodiment of the present invention.

The triangular structure 30 provides superior stiffness over previous fan designs. The direction and shape of the helical gussets which extend on the rear faces of the blade members 20 is shown in dotted lines 26 in FIG. 3. The triangular-shaped hollow sections 30 are also shown in FIG. 4.

The helical gussets 25 essentially extend the leading edge of the blade members into the hub region. This provides a smooth aerodynamic transition between the flow guide and the blade section surface. It also allows for additional material removal in the hub region upward of the area where the metal insert member 18 is positioned. Since the fan blade members cross the insert member 18 in a diagonal manner, any forward protrusion of the blade in the hub region would cause thicker sections to be formed. Thicker sections are not desired since they provide opportunity for void formations in the molding process and cause differential stresses to be formed when meeting thinner sections.

The hollowed sections 30 formed in the rear of the fan in the hub region below the helical gussets allow minimal blade sectional thickness throughout the fan structure.

Also on the rear of the fan members 10, a plurality of supporting and strengthening ribs 35 are provided. These are shown in FIG. 2. The ribs 33 provide additional stiffness and support for the fan structure, particularly around the metal insert member 18.

While preferred embodiments of the present invention have been shown and described herein, numerous variations and alternative embodiments will occur to those skilled in the art. Accordingly, it is intended that the invention is not limited to the preferred embodiments described herein but instead limited to the terms of the appended claims.

What is claimed is:

1. A fan structure comprising:

a hub member;

a plurality of blade members extending generally radially outwardly from said hub member, each of said blade members having a front surface and a rear surface, and each of said blade members having a root portion connected to said hub member and a tip portion at the distal end; and a plurality of helical supporting gusset members, the number of supporting gusset members corresponding to the number of blade members;

each of said supporting gusset members having a curved configuration and extending from the hub member in a root portion on the front surface of a first blade member to the trailing edge on the rear surface of an adjacent second blade member;

each of said supporting gusset members extending from the leading edge to the trailing edge along the rear surface of a blade member;

wherein said supporting gusset members provide stiffening support for each blade member and for each pair of adjacent blade members.

2. The fan structure as described in claim 1 wherein said supporting gusset members extend from substantially the mid-point of said first blade member.

3. The fan structure as described in claim 1 wherein said supporting gusset members form substantially triangular-shaped structures with said hub member on the rear surfaces of each blade member.

4. The fan structure as described in claim 1 wherein said hub member, blade members and supporting gusset members are integrally molded together.

5. The fan structure as described in claim 4 wherein the fan structure is made from a plastic material and made by an injection molding process.

6. The fan structure as described in claim 1 wherein each of said supporting gusset members on the rear surfaces of each of said blade members decrease in axial dimension from the leading edge to the trailing edge.

* * * * *